US007992818B2

(12) United States Patent
Maddaleni et al.

(10) Patent No.: US 7,992,818 B2
(45) Date of Patent: Aug. 9, 2011

(54) CORELESS ROLL OF WEB MATERIAL, MACHINE AND METHOD FOR ITS PRODUCTION

(75) Inventors: Romano Maddaleni, Pisa (IT); Mauro Gelli, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 368 days.

(21) Appl. No.: 11/919,666

(22) PCT Filed: Apr. 27, 2006

(86) PCT No.: PCT/IT2006/000288

§ 371 (c)(1),
(2), (4) Date: Nov. 14, 2007

(87) PCT Pub. No.: WO2006/117821

PCT Pub. Date: Nov. 9, 2006

(65) Prior Publication Data

US 2009/0101748 A1 Apr. 23, 2009

(30) Foreign Application Priority Data

May 2, 2005 (IT) ..... FI2005A0086

(51) Int. Cl.
*B65H 39/14* (2006.01)

(52) U.S. Cl. ..... 242/528; 242/532.1; 242/532.2; 242/532.3

(58) Field of Classification Search ..... 242/160.1, 242/520, 528, 532.1–532.3
See application file for complete search history.

(56) References Cited

U.S. PATENT DOCUMENTS

| | | | | |
|---|---|---|---|---|
| 5,344,091 | A * | 9/1994 | Molison | 242/527.1 |
| 5,397,284 | A | 3/1995 | Matsumoto et al. | |
| 5,538,199 | A | 7/1996 | Biagiotti | |
| 5,603,467 | A | 2/1997 | Perini et al. | |
| 5,639,046 | A | 6/1997 | Biagiotti | |
| 5,690,296 | A | 11/1997 | Biagiotti | |
| 5,722,608 | A | 3/1998 | Yamazaki | |
| 5,839,680 | A | 11/1998 | Biagiotti | |
| 2002/0190152 | A1 * | 12/2002 | Haraikawa et al. | 242/520 |

FOREIGN PATENT DOCUMENTS

EP 0 698 570 A1 2/1996

OTHER PUBLICATIONS

Patent Abstracts of Japan—"Winding Up Method for Coreless Toilet Paper", JP 06 171807 A published Jun. 21, 1994; Shimizu Seisakusho KK.

Patent Abstracts of Japan—"Coreless Roll-Like Aluminum Foil", JP 09 295726 A published Nov. 18, 1997; Kaji Seisakusho KK.

Patent Abstracts of Japan—"Coreless Roll-Like Flexible Synthetic Resin Film", JP 2004 042920 A published Dec. 2, 2004; Kaji Seisakusho KK.

* cited by examiner

*Primary Examiner* — Sang Kim
(74) *Attorney, Agent, or Firm* — Breiner & Breiner, L.L.C.

(57) ABSTRACT

A method is described for obtaining a coreless roll (R) of web material with a first portion of web material forming an inner nucleus (R1) of said roll and a second portion of web material (R2) wound around the outside of said nucleus. The two portions (R1, R2) can be separated from one another and, for said purpose, an interface or discontinuity is created in at least one turn of the web material forming the roll, between said inner nucleus and said second portion of web material, so as to facilitate the extraction of the inner nucleus from the outer portion of the roll.

49 Claims, 16 Drawing Sheets

59
C
53
F
55
51A
57
51B
N
$f_N$
3
7
11A
11
15
5

N
$f_N$
59
59
51A
53
51B
53
55
55
F
57
57
F
F
P
F
3
7
L
11A
$f_{11}$
11
15
5

CORELESS ROLL OF WEB MATERIAL, MACHINE AND METHOD FOR ITS PRODUCTION

TECHNICAL FIELD

The present invention relates to improvements to the production of rolls of web material, such as paper, and so-called tissue paper in particular. The invention specifically concerns improvements to the machines and to the manufacturing methods, as well as to the rolls of material.

STATE OF THE ART

Rolls of toilet paper, kitchen towels and other tissue paper products are usually wound around winding cores or tubes made of cardboard or other material. These winding cores are inserted in the rewinder machine and the required quantity of paper is wound around them. The resulting rolls, called logs, are subsequently cut into smaller rolls, i.e. of lesser axial length, destined for the consumer. The winding cores are normally made in machines in which two or more strips of cardboard are helicoidally wound around a spindle. These machines, and the material needed to manufacture the winding cores, represent a cost with a considerable influence on that of the end product, as well as adding to the complexity of the production line. To avoid the need to use winding cores and to obtain products in rolls that contain a larger quantity of wound material, various systems, methods and machines have been studied that enable rolls to be manufactured without using a winding core or central tube. Examples of such machines and methods are described in U.S. Pat. Nos. 5,603,467; 5,538,199; 5,639,046; 5,690,296; 5,839,680.

The rolls obtained by means of these techniques have a compact appearance and no empty areas in the middle. This can represent a drawback for their use, in that the majority of the dispensers for products in roll form have an axial holder that is inserted in the hole of the winding cores on which such products are usually wound. The absence of such a central hole has effectively restricted the use of rolls obtained by the above-mentioned machines and methods, despite products without winding cores offer considerable advantages, including a greater quantity of wound paper for the same outer diameter of the roll, the absence of core-making machinery in the production line, savings on the raw materials (glues, cardboard) needed to manufacture the tubular cores, an easier procedure for cutting the logs into rolls, and the lack of waste material (the central core) after the rolls have been used up.

OBJECTS AND SUMMARY OF THE INVENTION

An object of the present invention is to provide a roll that offers the advantages of rolls without a winding core, but without presenting the above-mentioned characteristic drawbacks. Another object is to provide a roll with innovative characteristics if compared with traditional rolls.

According to another aspect, an object of the invention is to provide a rewinder system or machine that enables a new type of roll to be manufactured without any central winding core, without the previously-discussed drawbacks and with innovative features if compared with conventional products.

A further object of the present invention is to provide a winding method for manufacturing a new type of roll without a central core and with other innovative characteristics.

Basically, according to a first aspect, the invention relates to a roll of web material with no central winding core, wherein a first portion of web material forms the inner nucleus of the roll, and a second portion of web material is wound around the outside of said nucleus, and wherein a separator material is applied to at least one turn of the web material coming between said inner nucleus and said second portion of web material, covering a length corresponding to at least approximately half a turn of web material.

The presence of this separator material between the nucleus portion and the outer portion of the roll enables the nucleus to be extracted from the remainder of the roll, tearing the web material in line with the interface between the inner portion of the roll forming the nucleus and the outer portion forming the remainder of the roll. In this way, the roll originating as a solid, completely full configuration, thus avoiding the need for a winding core or spindle, offers all the advantages deriving from the absence both of a central winding core and of a central hole during the manufacturing process and also during distribution, whereas the end users can choose whether to use the roll whole, e.g. when they have an adequate dispenser available, which has no axial roll holder, or to slide the nucleus out of the roll, leaving the remainder of the roll with a central hole of suitable dimensions (of the range of 1.5 to 3 cm, for instance) to enable its insertion on the axial holder of a conventional dispenser. In addition to this dual usage option, the central nucleus that is extracted from the outer portion of the roll is also a product suitable for use by the consumer. For instance, the central nucleus of a roll of tissue paper, such as a roll of toilet paper, could also be used as a compact, portable toilet roll for carrying in a handbag or in a motor vehicle.

Indeed, it is frequently necessary to have small rolls of tissue paper available for journeys and it is common knowledge that the last part of normal rolls of toilet paper or kitchen roll are often used for this purpose, though they have the drawback of carrying a limited amount of paper with respect to their overall dimensions (due mainly to the unused volume of the tube or winding core in the middle). The nucleus of the roll according to the invention, on the other hand, is a compact roll of wound paper, with no waste of space.

The product obtained according to the invention consequently has the characteristic of consisting substantially of a combination of two independently usable products, generated by the same manufacturing procedure and the same machine, but separable at the time of their use.

Instead of applying a separator product (be it in sheet or in the form of loose material), provision can be made for an area of separation to be created between the inner portion or nucleus of the roll and its outer portion of the roll by means of a local variation in the density of the winding. For instance, the winding density can be temporarily reduced, even for just a very limited number of turns, thereby creating an area of lower-density winding in the roll that separates the portion of inner nucleus from the outer portion of the roll.

In another embodiment of the invention, between the inner portion or nucleus and the outer portion, an adequate number of turns can be inserted (or even only one turn, or a number of turns varying from 1 to 50, and preferably from 1 to 20, or from 1 to 10, or any adequate number of turns) in which at least one surface characteristic of the web material has been modified, e.g. the surface roughness has been reduced. This can preferably be achieved by means of a calendering process on the relevant stretch of web material.

Basically, and in general terms, therefore, the invention involves the manufacture of rolls having a central nucleus or portion and an outer portion, wherein an interface is created between the two portions, that facilitates the mutual sliding between said inner and outer portions.

According to a further embodiment, the invention involves the manufacture of rolls with a nucleus portion or central portion and an outer portion, wherein there is a discontinuity between the two portions that facilitates the mutual sliding between said inner and outer portions. Thus, the invention also relates to a wound roll of web material, preferably such as tissue paper, wherein two distinct portions are obtained, an inner or central portion and an outer or peripheral portion, capable of sliding mutually with respect to one another so as to extract, or withdraw the first portion from the second. The roll is preferably without a central hole or winding core and the central portion of the roll consists of turns of web material wound one around the other.

In an advantageous embodiment, the web material has transversal perforation lines, along which single sheets of web material e.g. tissue paper, can be detached by the end user. In this case, it is advantageous to provide for the separator material to be applied in line with one such transversal perforation line on the web material. This facilitates the tearing of the web material and consequently makes it easier to slidingly extract the nucleus from the outer part of the roll, without disturbing the turns of web material arranged in line with the interface between the two portions of the roll.

The separator material can be applied to just one side of the web material, or to both sides—in which case its application is preferably staggered between the two sides, while a transversal perforation line is preferably included in the area of overlap between the separator materials applied on either sides of the web material. As explained in the description provided with reference to several examples of embodiment of the invention, this makes it easier to separate the two parts of the roll.

The separator material may be a loose, liquid, semi-liquid or solid material, applied to one or other, or both sides of the web material. For instance, it may be a waxy material that makes the surface of the web material suitably slippery, reducing its coefficient of friction in line with the one or more turns that separate the central nucleus from the outer portion of the roll, and thereby facilitating the mutual sliding of the two parts in relation to one another.

The separator material will preferably be in the form of sheets, however, made of a product with a relatively low friction coefficient, e.g. compact paper, such as writing paper, photostat copier paper, printer paper or the like, or a plastic with suitable features, a sheet of waxed paper, or the like.

If the separator material is loose, it may be applied by spraying or with a doctor blade or brushes, or other spreading means. When the separator material is in the form of a sheet, on the other hand, it is preferably anchored to the web material, e.g. with the aid of an adhesive. Alternatively, it can be made to adhere to the web material by mechanical crimping or ultrasound, embossing, electrostatic charging, or any other suitable means.

The web material forming the roll is preferably paper, and especially tissue paper, though this does not rule out the possibility of applying the same inventive concept to the production of rolls of web material of any other nature, such as plastic. Important is that, at the point of separation between the nucleus and the remainder of the roll, i.e. at the interface between the two portions required to slide with respect to one another, the friction is lower than between the remainder of the turns of wound web material. This enables the central nucleus to slide out without producing any telescoping effect.

The diameter of the central nucleus of the roll can vary, depending on the intended use of the roll. According to an advantageous embodiment, it will be between 0.5 and 5 cm, and preferably between 1 and 3 cm. When the web material to wind is tissue paper of the type generally used to manufacture toilet paper or the like, a diameter of the inner nucleus of approximately 20 mm equates to a length of approximately 1.5 m of wound paper, a quantity sufficient for portable uses.

A perfume or lotion may be applied to the length of web material forming the inner portion R1 of the roll, and/or to the separator material.

According to another aspect, the present invention concerns a method for manufacturing a roll of web material wound up without any central winding core, comprising the following stages:

- curling the leading end of said web material and winding it to form a first nucleus of said roll with a first length of web material;
- generating an interface, or discontinuity, e.g. by applying a separator material on at least one side of said web material;
- continuing to wind on a second length of web material to complete said roll.

According to yet another aspect, the invention concerns a rewinder machine for the manufacture of a roll of web material wound up without a central winding core, comprising a winding unit (preferably of peripheral type), wherein the web material is wound up around its loose leading end to form a roll with a central nucleus, and an outer portion is wound around said central nucleus. Characteristically, the machine comprises a device for generating an interface or discontinuity between an inner portion and an outer portion of the wound material, said interface or discontinuity facilitating the axial mutual sliding and consequent separation of said two portions.

In a possible embodiment, this device comprises a device for applying a separator material to the web material being wound onto the roll, said applicator being operated so as to apply said separator material after the formation of said central nucleus.

In a different embodiment of the invention, there may for instance be a calendering device, which is temporarily enabled to generate a length of Web material the surface of which is modified, i.e. preferably made smoother, to form said interface. Generally speaking, along the path along which the web material is fed to a winding cradle or a winding unit, a device that changes at least one surface characteristic of the web material in a pre-determinable portion of adequate length of said material. According to a possible embodiment, this modified characteristic consists in the roughness of the web material.

Further advantageous features. and embodiments of the roll, of the method and of the rewinder machine according to the invention are stated in the attached claims and are described in greater detail with reference to several embodiments.

BRIEF DESCRIPTION OF THE DRAWINGS

The invention is better illustrated with the aid of the description and the attached drawing, which shows examples of embodiments without restricting the scope of the invention. To be more precise, in the drawing.

DETAILED DESCRIPTION OF PREFERRED EMBODIMENTS OF THE INVENTION

Figure 1:
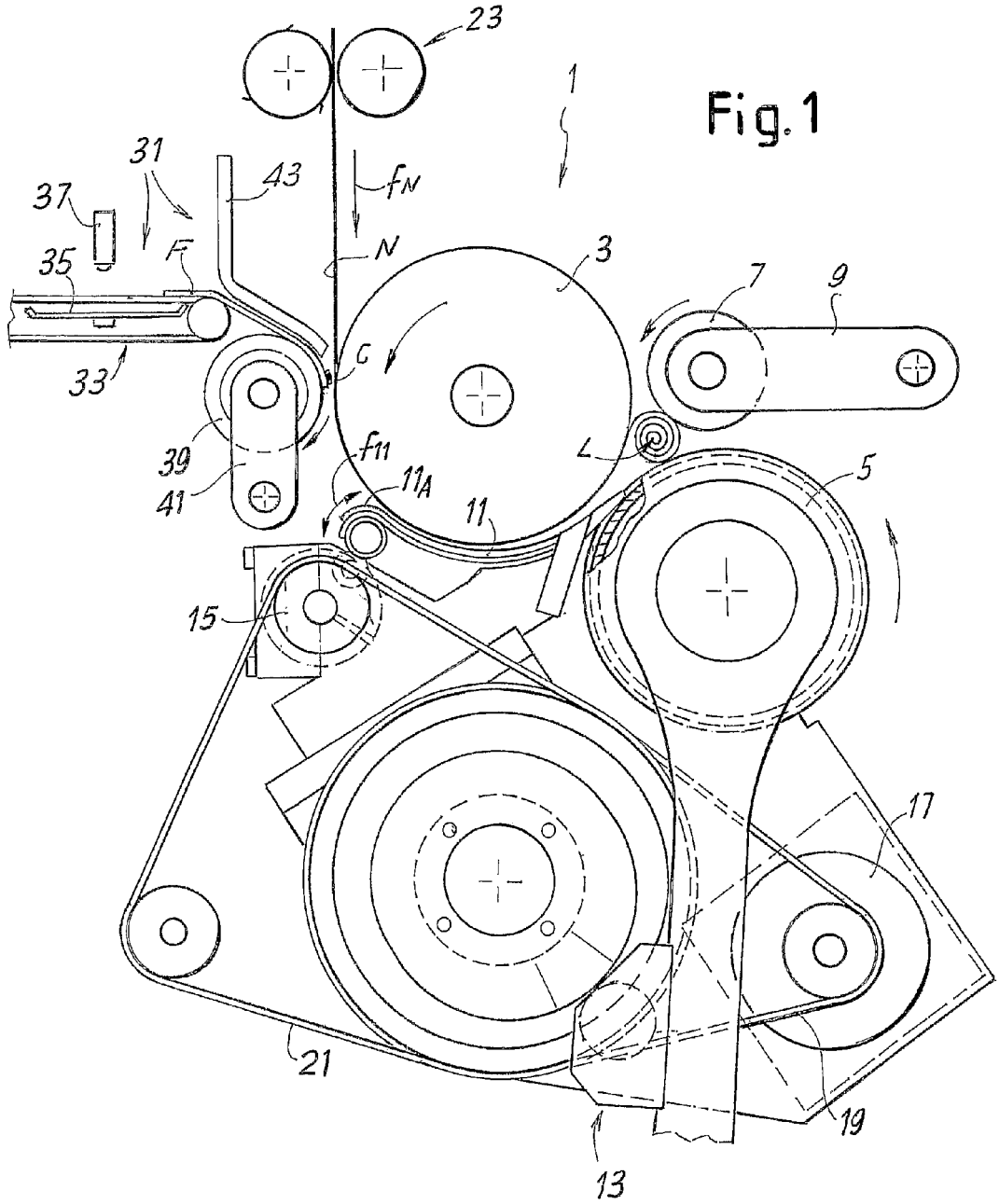
FIG. 1 schematically shows a first embodiment of a rewinder according to the invention.

Referring initially to FIG. 1, in a first embodiment, the invention involves the use of a rewinder configured (inasmuch as concerns the winding elements) essentially as described in U.S. Pat. No. 5,639,046, to which reference is made for a more detailed description of the structural characteristics and operation of this type of rewinder.

FIG. 1 shows the essential parts of the winding head. The rewinder, globally indicated by the numeral 1, comprises a first winder roller 3, a second winder roller 5 and a third winder roller 7. The three winder rollers form a winding cradle wherein a roll or log L is formed. The log L formed by the rewinder is subsequently cut, crosswise to its own axis, into single rolls of axial length corresponding to the length of the end product.

The winder roller 7 is carried by oscillating arms 9 and is gradually raised to enable and control the growth of the log L. The three rollers 3, 5, 7 turn in the same direction (anticlockwise in the example) at a substantially equal peripheral rate during the winding of the roll or log L, while the speed of the lower winder roller 5, and possibly also the roller 7 for controlling the diameter, varies (the former decelerating, the latter accelerating) in the exchange phase, i.e. when the completed roll or log L is unloaded and a new log L in the initial winding stage is loaded according to methods that are known to those skilled in the art.

A nip is created between the rollers 3 and 5, through which the web material N to be wound up to form the roll or log L is passed (fed in the direction of the arrow fN). Upstream from the nip between the rollers 3 and 5, there extends a concave surface 11 consisting of a curved sheet of metal, carbon fiber reinforced resin or other suitable material. This concave surface is provided with an oscillating movement in the direction of the arrow f11 for pinching the web material N against the outer surface of the winder roller 3, thereby inducing the tearing of the web material and consequently prompting the central portion of a new log to start being fashioned by means of the curling of the leading end of the severed web material, as described in more detail in the previously-mentioned U.S. Pat. No. 5,639,046.

The numeral 13 indicates a unit supporting the surface 11 and capable of moving closer to, or further away from the roller 3 so as to bring the surface 11 closer to, or further away from said roller. The unit 13 also supports a control mechanism 15 driven by a motor 17 by means of belts 19 and 21, for inducing a rapid pinching of the web material N by the portion 11A of the curved surface 11 against the cylindrical surface of the roller 3, as already described in the previously-mentioned U.S. Pat. No. 5,639,046.

Along the path of the web material N being fed to the winding head, there is a perforator, schematically indicated by the numeral 23, that generates transversal perforation lines on the web material N to divide the material into single portions detachable by tearing along the perforation line when the finished roll is in use.

Characteristically, upstream from the inlet to the channel defined between the outer surface of the winder roller 3 and the concave surface 11, there is a separator material applicator, consisting of a sheet feeder indicated by the numeral 31 as a whole, the purpose of which is to insert single sheets F of paper, plastic or other suitable material of a given length at preset times along the feed path of the web material N.

The applicator 31 comprises a conveyor 33 with an associated suction box 35 situated underneath the upper branch of the conveyor 33. One, or a row of several nozzle(s), schematically indicated by the numeral 37, are arranged along the conveyor 33 and, in a pre-established position on the surface of the sheet F in transit on the conveyor 33, they apply an adhesive in order to make said sheet adhere to the web material N in a manner described later on.

Downstream from the conveyor 33, there is a roller 39 that is kept constantly in rotation in a direction congruent with the direction in which the web material N is fed forward, the path of which travels between the roller 39 and the winder roller 3. The roller 39 is mounted on oscillating arms 41 controlled by means of an actuator (not shown) so as to push the roller 39 up against the roller 3 at a predetermined moment to apply the sheet F to the web material N.

The sheet F is fed forward by the conveyor 33 until it occupies the position schematically illustrated in FIG. 1, wherein the leading end of the sheet F is withheld against the outer surface of the rotating roller 39, which can be perforated over its entire surface, for instance, and maintained at a negative pressure on the inside by means of a fan. A deflector 43 guides the sheet F so that it comes to rest correctly on, and remain attached to the turning cylindrical surface of the roller 39. The suction force exerted by the suction box 35 is stronger than the suction exerted by the rotating roller 39, and consequently withholds the sheet F up until it is inserted, in a manner described later on, in the path of the web material N. As an alternative to the suction box 35, there may be other types of retention means, e.g. mechanical devices.

With a configuration of this type, when the rewinder 1 has begun to wind a new roll or log L and has formed the first central portion or nucleus of said log, the roller 39 is pressed against the winder roller 3 and, since the two rollers turn at a peripheral speed corresponding to the speed of the web material N, this makes the leading end of the sheet F adhere to the web material N (due to the adhesive applied by the nozzles 37) and induces the consequent forward feed of the said sheet F, together with the web material N, towards the winding area where the log L is formed. Thus, as will also become clear from a detailed description of a sequence of operations, inside the log L being formed without a central hole or winding core, there will be one or more turns formed by the sheet F, consisting of a material with a low friction coefficient, or in any case smoother than the web material N, which is typically tissue paper for the preparation of rolls of toilet paper, kitchen paper or the like.

For instance, the sheet F can be a sheet of plastic or even, more simply, a sheet of printer paper, photocopier paper or the like, typically. with a weight ranging between 25 and 100 $g/m^2$. As will be clarified in more detail later on, this paper—being smoother than the tissue paper forming the web material N—enables the detachment and extraction of the central nucleus from the outer portion of each roll (obtained after cutting the log L created by the rewinder crosswise), thereby creating a hole inside the finished roll.

Figure 2:
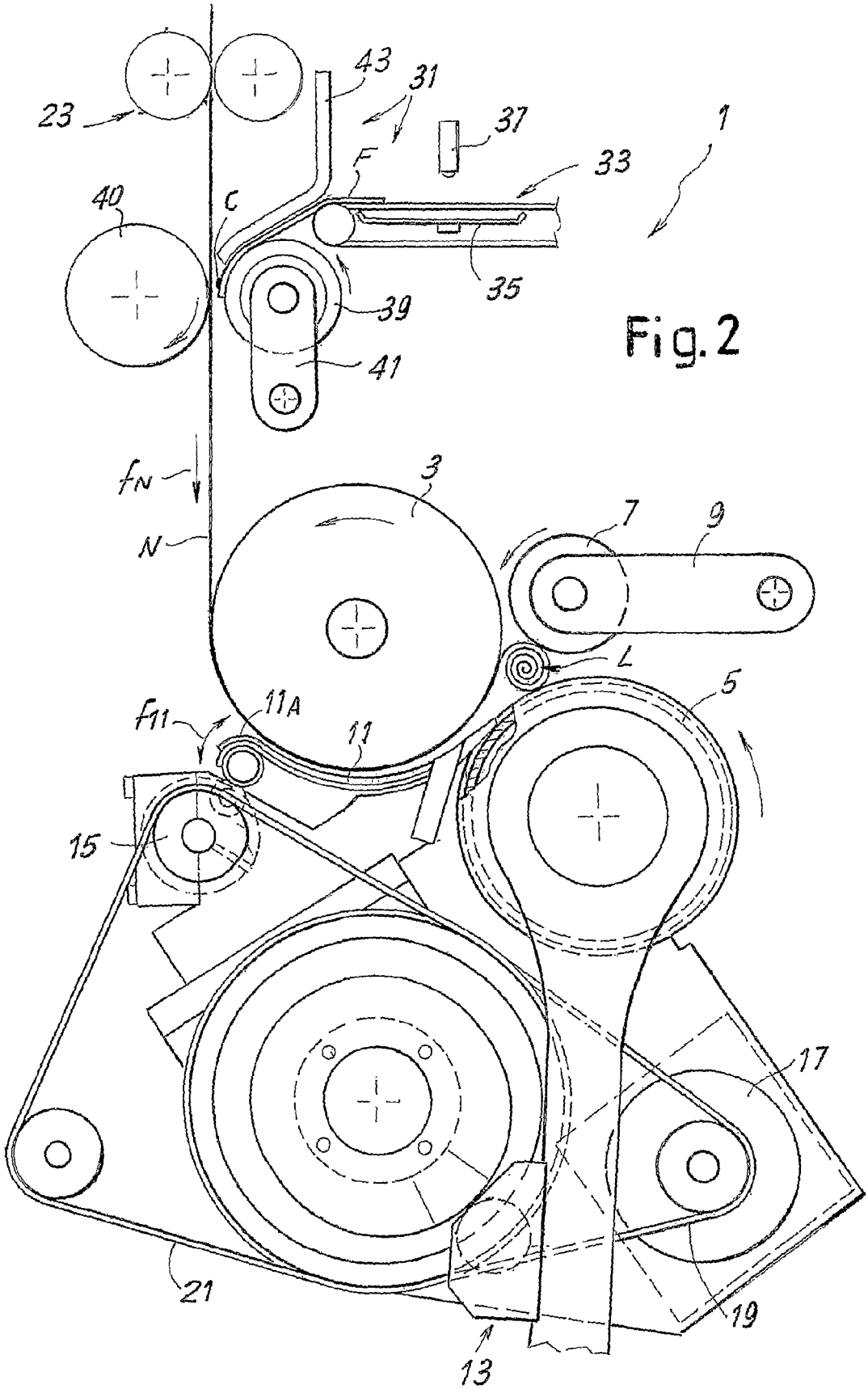
FIG. 2 shows a modified embodiment of the rewinder according to the invention.

FIG. 2 shows a rewinder 1 basically the same as the one described with reference to FIG. 1, except for a different arrangement of the feeder 31 of the sheets F. In this case, the feeder 31 is arranged on the same side—vis-à-vis the path of the web material N—as the winder roller 3. The rotating roller 39 cooperates with a counter-roller 40, instead of the winder roller 3, to perform the same procedure for applying the sheet F on the web material N as it advances continuously and at a substantially constant speed in the direction of the arrow fN. The letter C indicates an adhesive applied by the nozzles 37 in the vicinity of the leading end of the sheet F.

Figure 3:
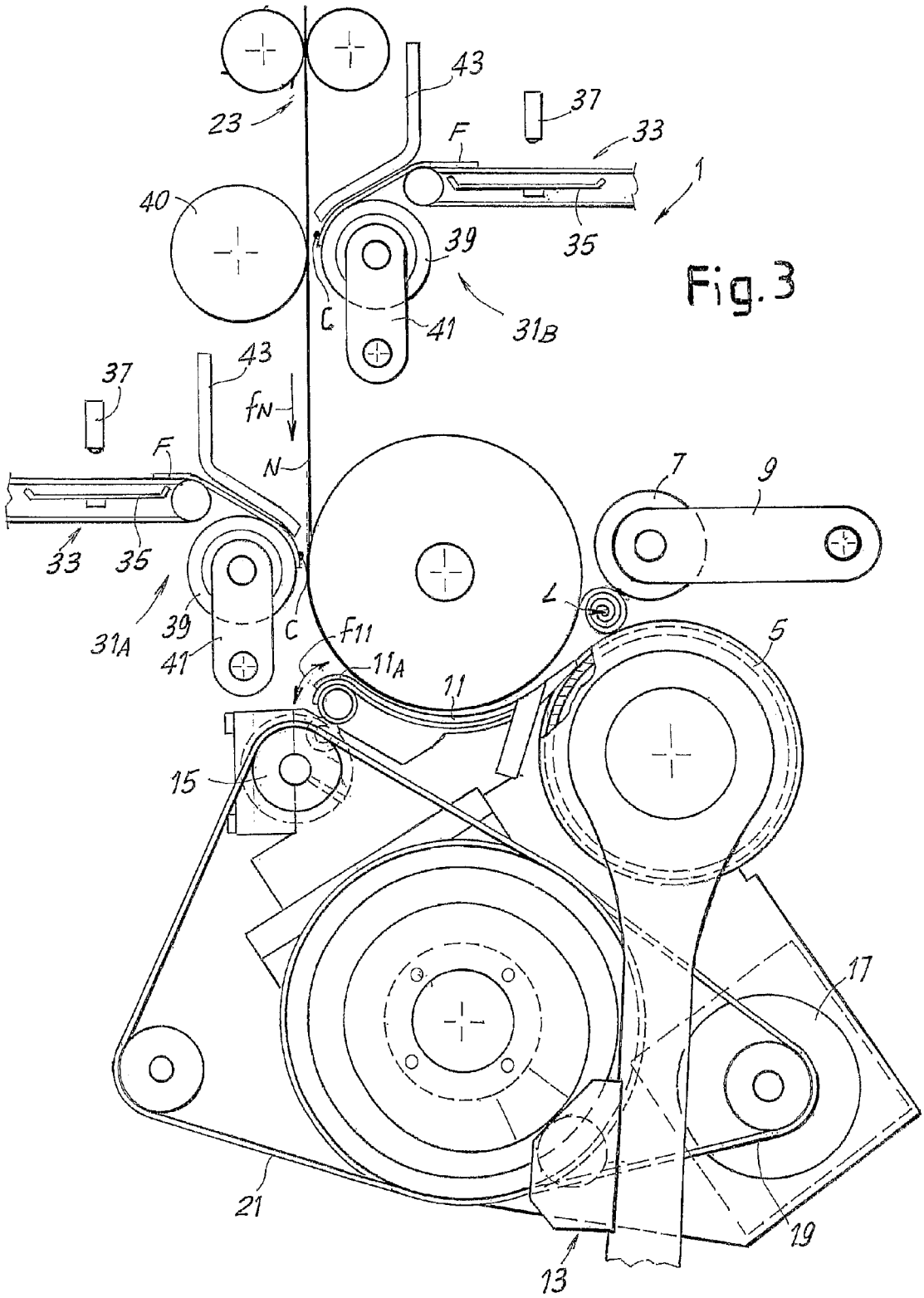
FIG. 3 shows a further embodiment of the rewinder according to the invention.

FIG. 3 shows a rewinder 1, much the same as the one shown in FIGS. 1 and 2, but provided in this case with two sheet feeders, indicated respectively as 31A and 31B. The feeder 31A is made and arranged in the same way as the feeder 31 of FIG. 1, while the feeder 31B is made and arranged in the same way as the feeder 31 of FIG. 2. This configuration enables the application of a sheet F on each of the opposite sides of the web material N as it advances substantially continuously along its path towards the winding cradle formed by the rollers 3, 5 and 7.

Figure 4:
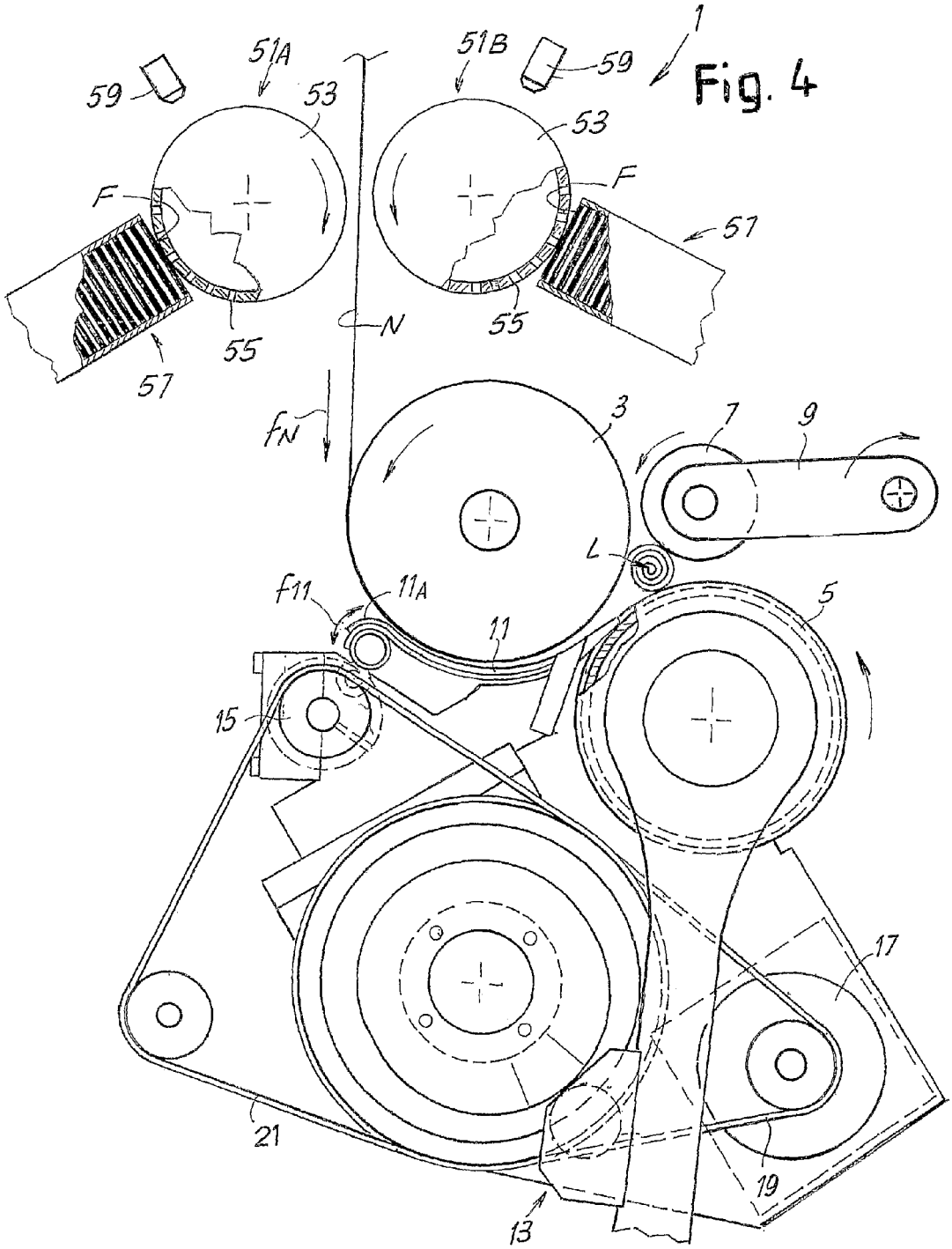
FIG. 4 shows a fourth embodiment of the rewinder according to the invention.

FIG. 4 shows an embodiment of a rewinder, again indicated by the numeral 1, which has two feeders, indicated here as 51A and 51B, arranged on either side of the path of the web material N, so as to attach two sheets on said material N, as in the case of FIG. 3, one on each side. The winding area of the rewinder 1 is substantially the same as the winding area of the rewinder 1 shown in the previous embodiments.

Each of the two feeders 51A and 51B has a revolving suction roller 53, with holes 55 on its surface. The two rollers 53 of the two feeders 51A and 51B rotate in opposite directions, as described below with reference to the sequence of FIGS. 5A-5E. Each roller 53 is associated with a magazine 57 of sheets F and an adhesive distributor 59 consisting, for instance, of a series of distributor nozzles. The rollers 53 can be brought up against one another and, for this purpose, are supported by oscillating arms (not shown) controlled by suitable actuators (not shown).

The operation of the rewinder in the configuration of FIG. 4 is now described in detail with reference to FIGS. 5A to 5E, the description of which will also clarify how the rewinder functions in the embodiment of FIGS. 1 to 3.

Figure 5A:
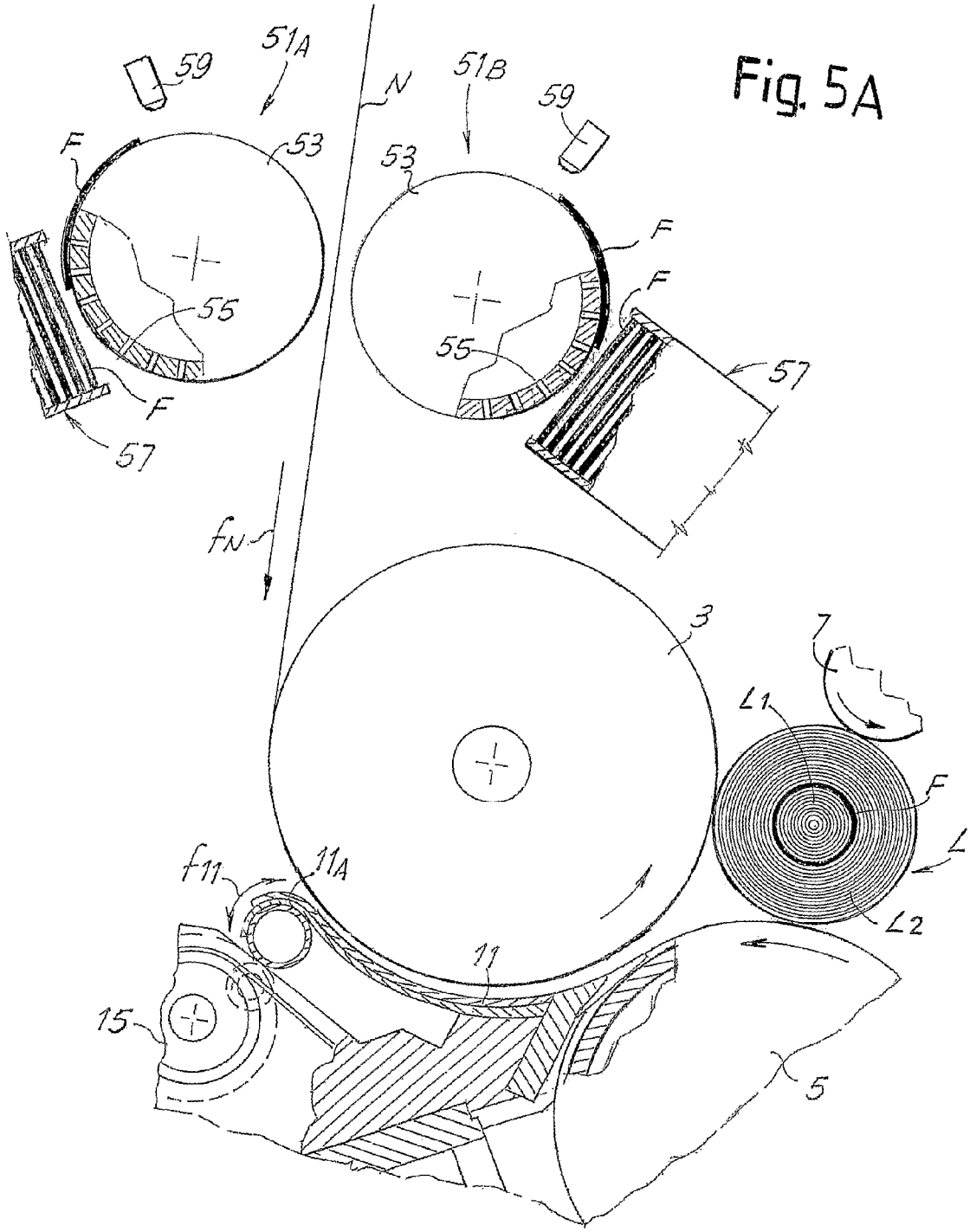
FIGS. 5A to 5E show a working sequence of the rewinder in the embodiment of FIG. 4.

In FIG. 5A, a roll or log L is being formed between the winder rollers 3, 5 and 7. The web material N advances in the direction of the arrow fN at a substantially constant rate, while the rollers 53 of the two feeders 61A and 53A wait and can each, in the meantime, collect a sheet F from their respective magazines 57. The sheets F are held in place on the outer surface of the two rollers 53 by suction. When the log L has been completed with the winding of the pre-established quantity of web material N, it is ejected, causing the tearing of the web material N by means of the pinching of the surface 11 against the winder roller 3. The contact between these two elements also makes the loose leading end of the web material formed by said tearing action start to curl and become wound around itself.

Figure 5B:
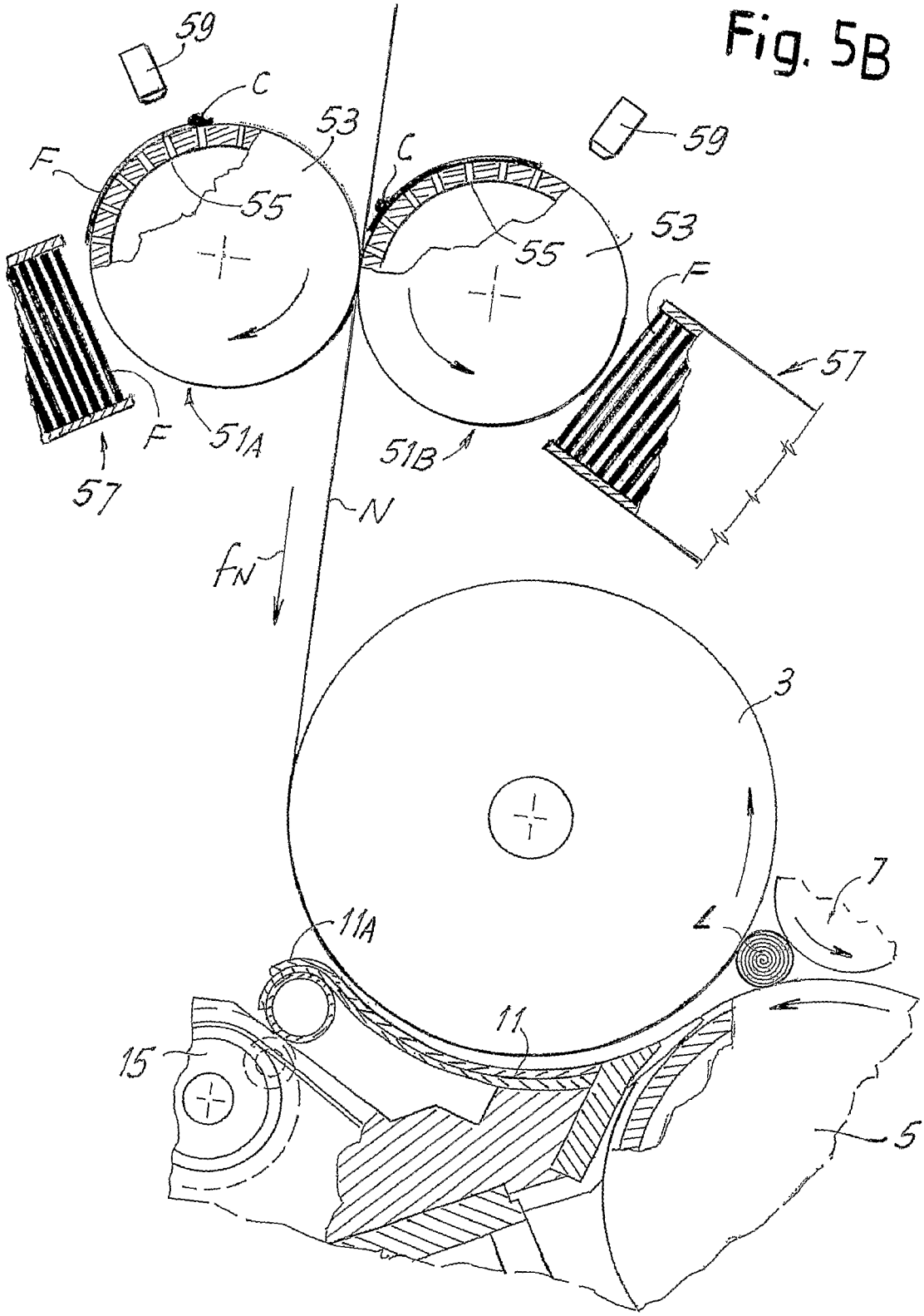

In FIG. 5B, the winding of a new log L begins, the previous roll or log L having been completed and unloaded from the winding cradle 3, 5, 7. The exchange stage and the start of the winding of a new roll are not illustrated in detail because they are substantially equivalent to those described in the earlier U.S. Pat. No. 5,639,046.

The rollers 53 are turned and their speed is accelerated up to a peripheral speed substantially corresponding to the feed speed of the web material N. A line of adhesive C has been applied in the vicinity of the leading end of each of the two sheets F. The first sheet F, which is attached to the side of the web material N facing towards the winder roller 3, is applied by the feeder 51B, while the second sheet F is applied by the feeder 51A to the opposite side of said web material N. The two sheets adhere to the web material N due to the effect of the adhesive C applied in the vicinity of the respective leading ends. The attachment of the sheets is assured by the two rollers 53 pressing one against the other, while they temporarily turn at a peripheral speed corresponding to the forward feed speed of the web material N, thus exerting a pressure on each of the sheets F and the web material N being fed into the nip defined by the rollers 53.

Figure 5C:
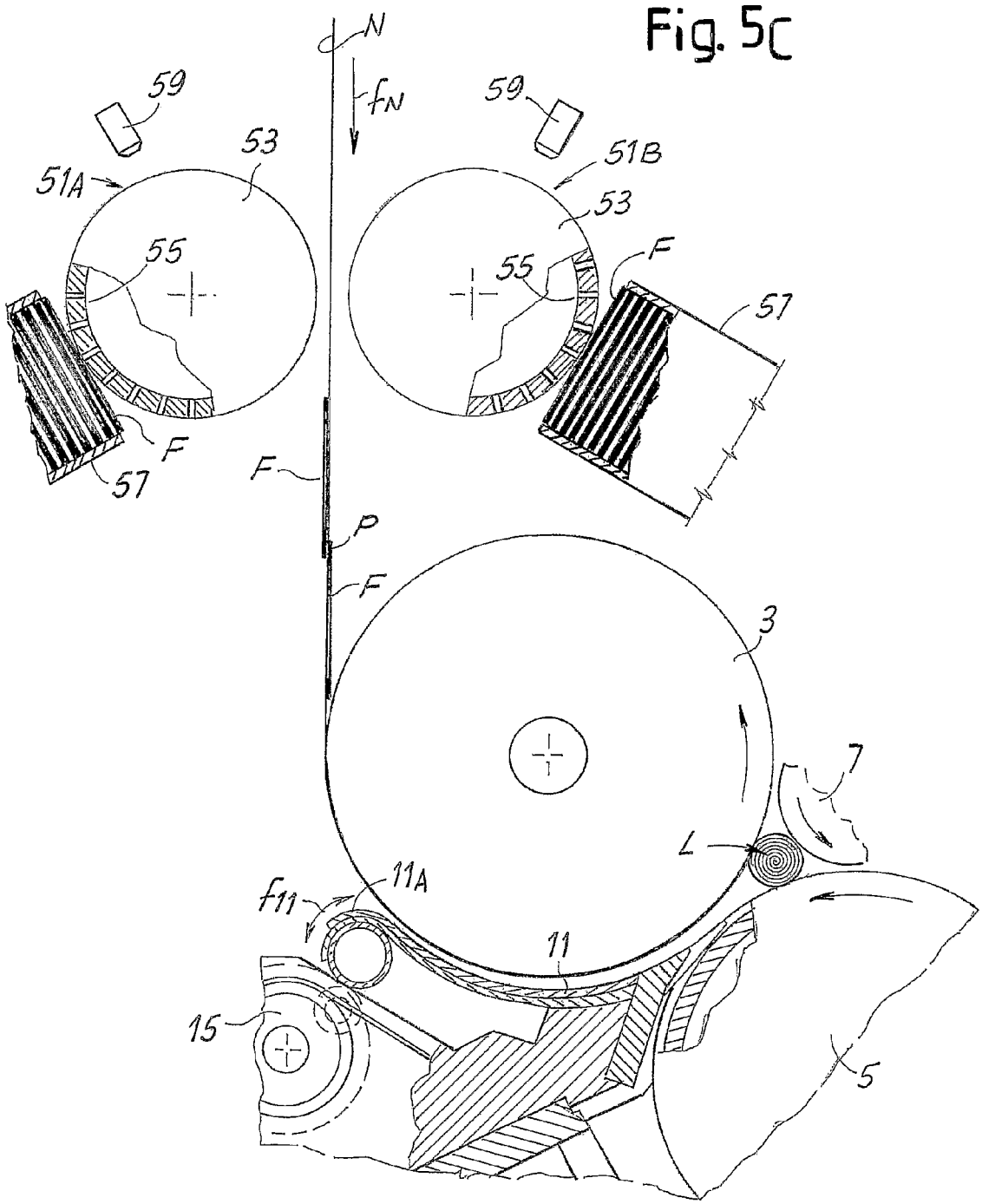

In FIG. 5C the two sheets F have been applied to the web material N, which continues to advance towards the winding cradle 3, 5, 7. As shown in FIG. 5C, in this example the tail end of the sheet F applied by the feeder 51B partially overlaps with the leading end of the sheet F applied by the feeder 51A. This is not essential, however; in fact, it is preferable for the two sheets to be a little distance away from one another. In this latter case, the tail end of the first sheet and the leading end of the second sheet, on opposite sides of the web material N, leave a portion of the web material N uncovered that coincides with a perforation line P created by the perforator 23 on the web material N (see FIG. 1, and the embodiment of FIG. 4). There may also be a partial overlap between the first and second sheets, as shown in the drawing. The important thing is for a perforation line P in the web material N to come between the two lines of glue applied to the two sheets.

Figure 5D:
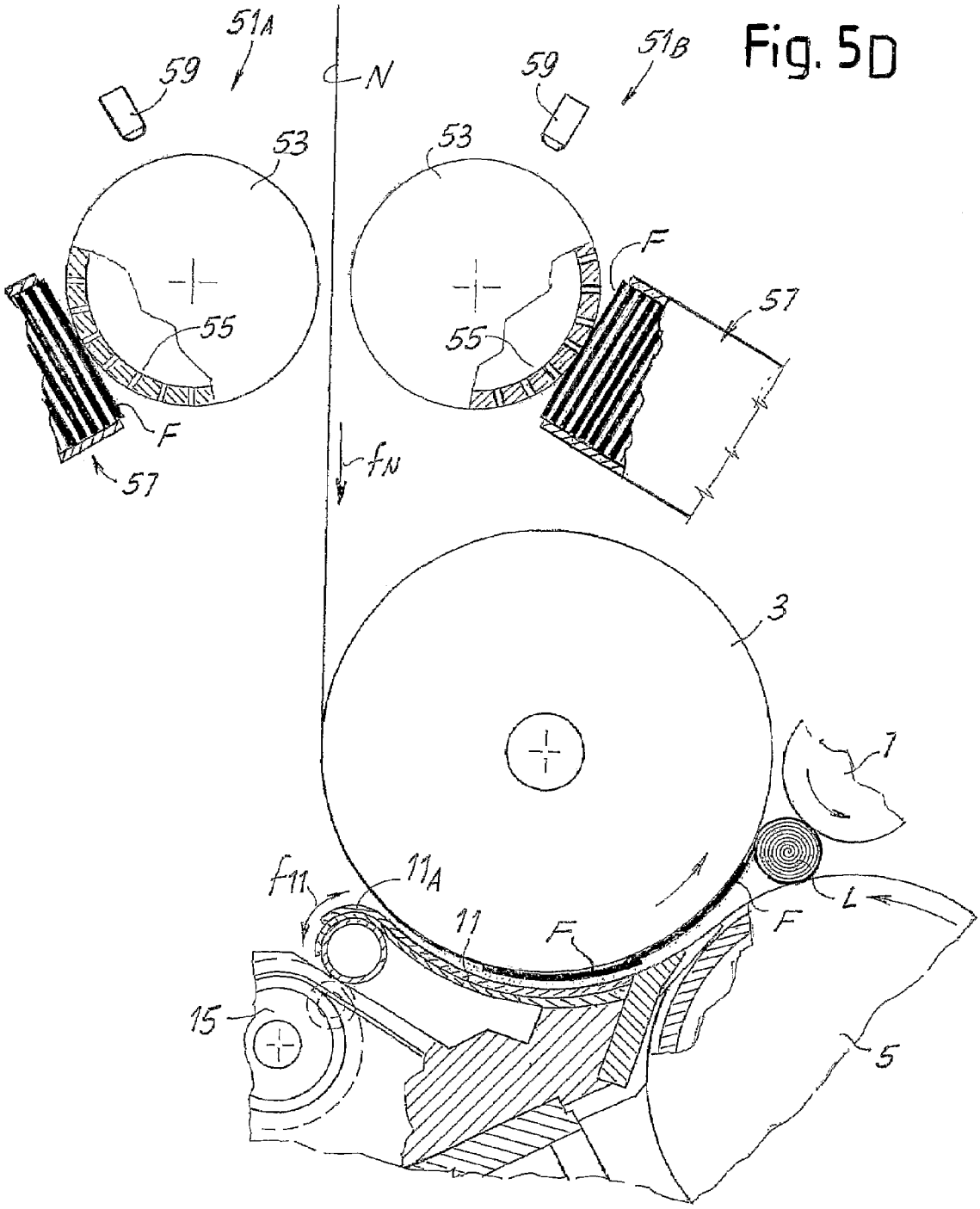

In FIG. 5D the two sheets F come to be in the area of the web material wound around the winder roller 3 and are about to be wound around the initial nucleus of the new roll or log L being formed in the winding cradle 3, 5, 7.

Figure 5E:
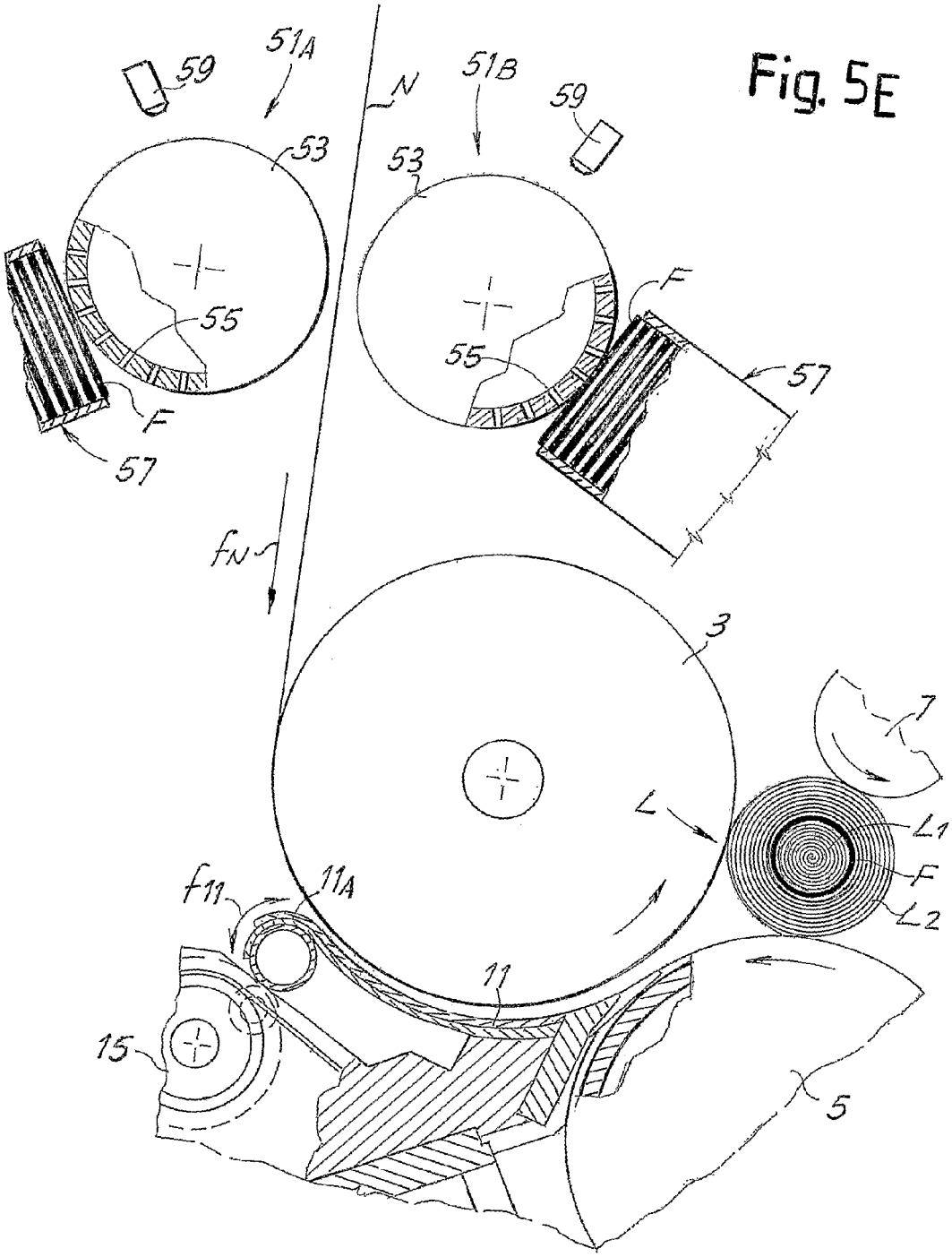

FIG. 5E shows how the log L further increases in diameter and the sheets F come to be inserted between the initial turns of the roll or log L, separating the central nucleus portion of the log indicated as L1, from the outer portion of the log L, indicated as L2. As we be explained later on, the finished rolls obtained after cutting the log L crosswise are compact and have no winding hole, but the inner portion of each roll, corresponding to the nucleus L1 portion of the log from which they were cut, can be extracted from the outer portion of said roll to generate a roll with a central hole and consequently similar to a roll obtained using conventional winding systems using tubular cores.

In fact, the sheets F applied to the web material N define surfaces of separation, or interfaces between overlapping turns of the web material N forming the log L, and consequently also the rolls obtained by cutting said log, and the layers can mutually slide along said separation surfaces, tearing the web material N along the perforation line P in the area between the tail end of one sheet F and the leading end of the opposite sheet F, i.e. between the two points where the sheets F are joined to the web material N.

Figure 6:
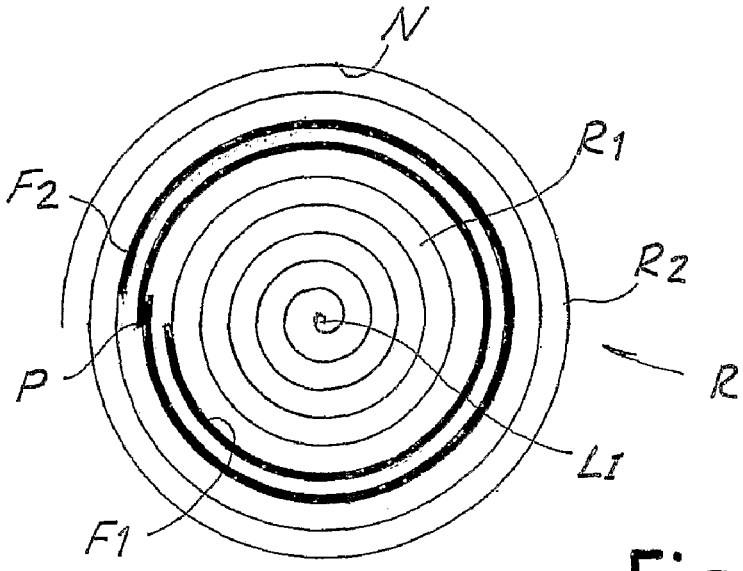
FIGS. 6, 7, 8, 9, 10 and 11 schematically show a roll according to the invention in various embodiments.
Figure 7:
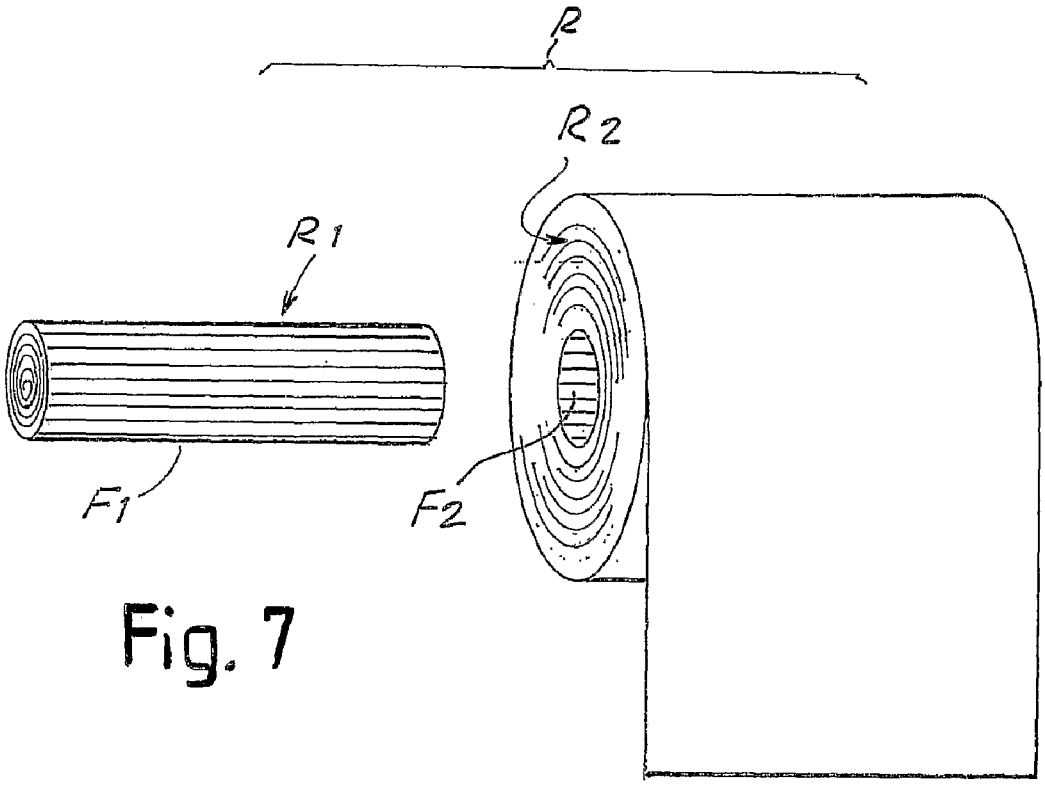

This concept is illustrated schematically in FIGS. 6 and 7. To be more precise, FIG. 6 shows a considerable enlargement of the internal area of a roll R obtained after cutting the log L crosswise, wherein R1 indicates the inner portion or nucleus and R2 indicates the outer portion surrounding the nucleus, said portions corresponding to portions L1 and L2 of the log L from which the roll R was obtained.

LI indicates the leading end of the web material N. F1 indicates the sheet applied by the feeder 51B or, to be more precise, the strip of said sheet remaining inside each roll R, after it has been cut from the log L. This sheet forms at least one turn (in the example illustrated, but it could form several turns), which completely surrounds the nucleus or initial portion R1 of the roll R. The sheet F2, corresponding to the sheet F applied by the feeder 51A, is arranged with its leading end (i.e. the innermost end) in the vicinity of the perforation line P and also forms one or more turns inside the roll.

By exerting a pressure on the flat outer surface of the nucleus R1 of the roll R, thus overcoming the mutual friction between the two sheets F1 and F2, the inner portion R1 slides out of the outer portion R2, tearing the web material N along the perforation line P created between the two overlapping ends of the sheets F1 and F2. This makes the inner nucleus R1 of the roll slide out of the outer portion R2 in such a manner that the latter has the appearance of a normal roll of paper wound around a tubular core. The portion of nucleus R1 remains wrapped in one or more turns formed by the sheet F1, while the wall of the hole created in the portion R2 of the roll is lined with the sheet F2.

Figure 8:
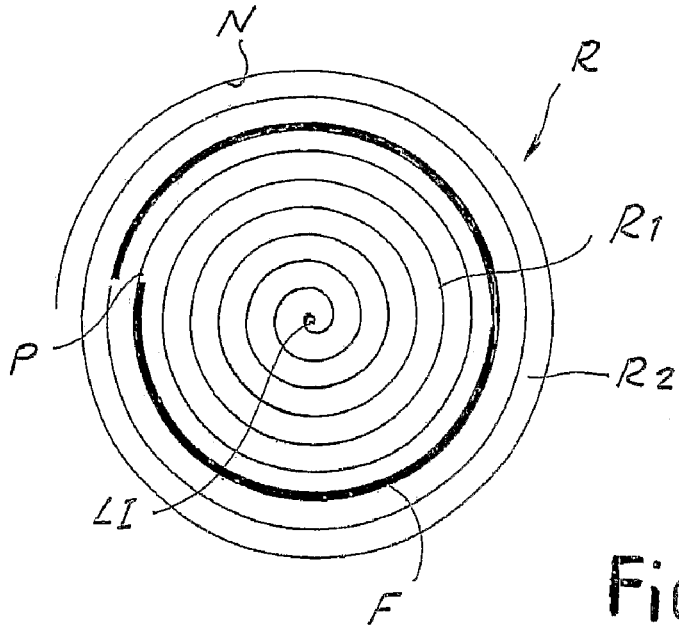
Figure 9:
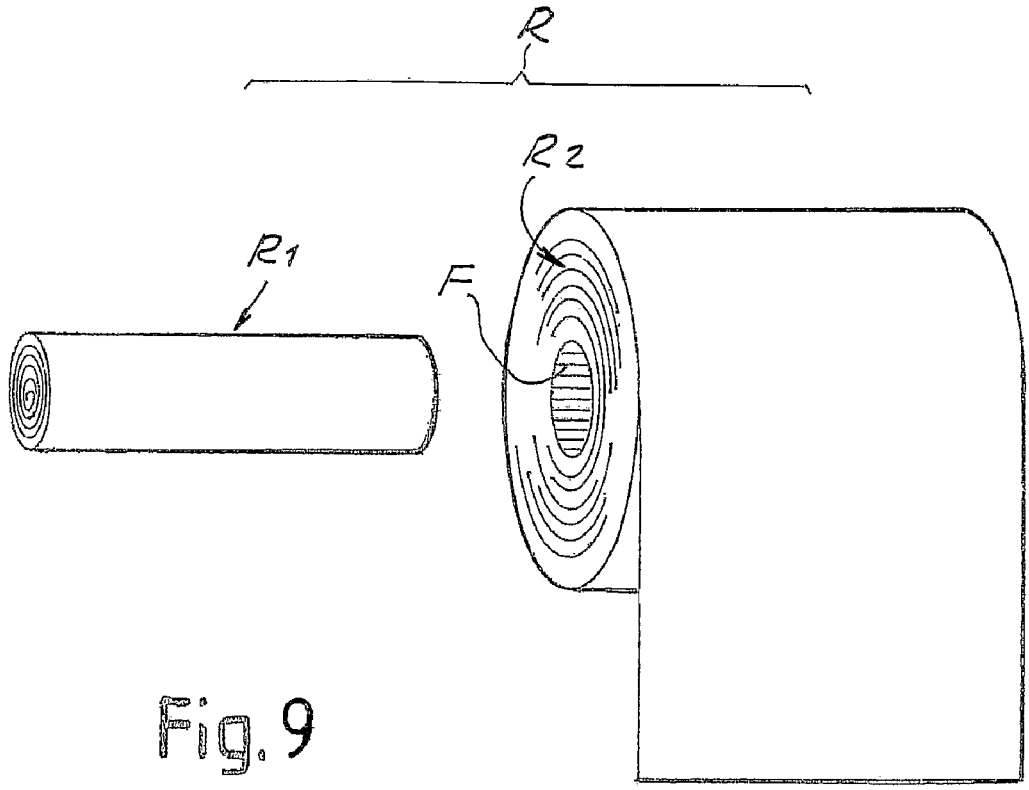

When the log L is formed with a rewinder of the type illustrated in FIG. 1, wherein only one sheet F is applied to the surface of the web material N that faces inwards, i.e. towards the axis of the log, the products obtained will be as illustrated in FIGS. 8 and 9. The central portion or nucleus R1 of the roll R is wound, in the example illustrated, in approximately one turn of the material forming the sheet F, the innermost end of which approximately coincides with a perforation line P. Pushing axially on the inner portion R1 of the roll R again enables the inner portion to be extracted due to sliding between the first turn of the outer portion R2 of the roll and the sheet F, which remains attached to the inner portion R1 of the roll R. FIG. 9 shows how, once the inner portion R1 has been extracted from the outer portion R2 of the roll, the hole in the outer portion R2 remains lined with the sheet F.

Figure 10:
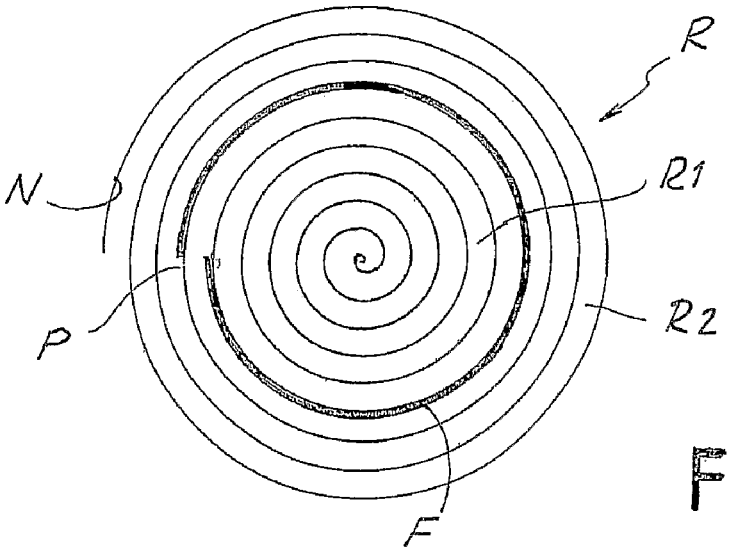
Figure 11:
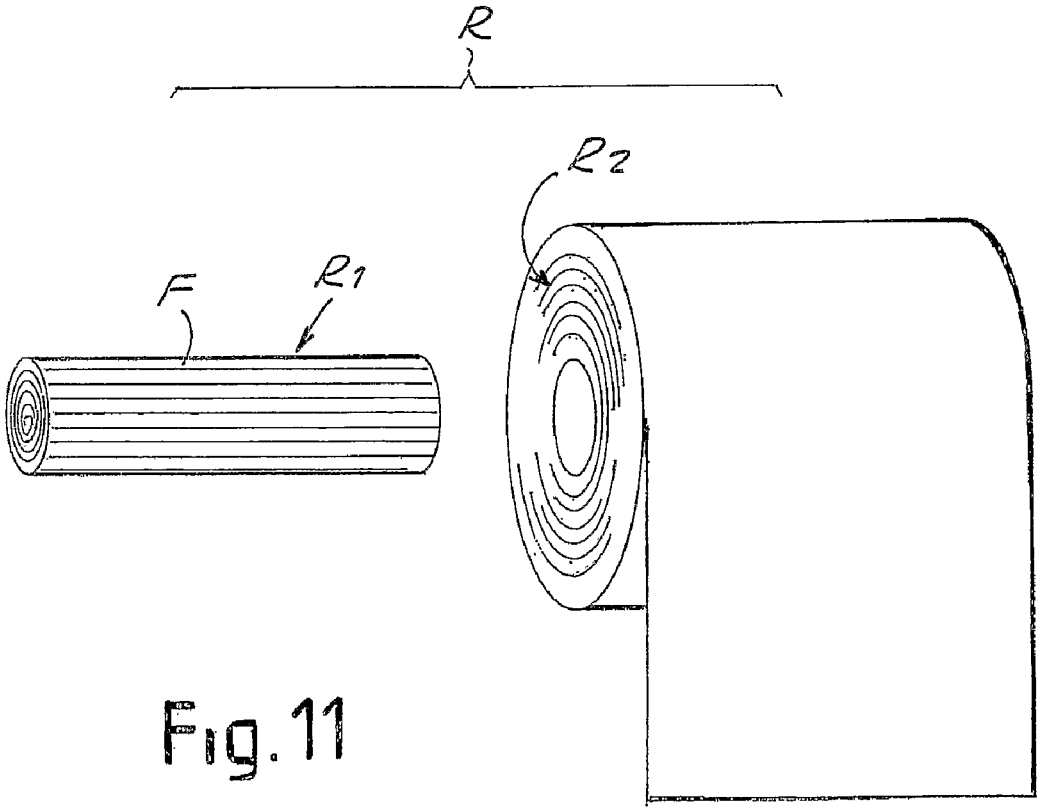

Vice versa, FIGS. 10 and 11 illustrate the situation in which the sheet F is attached to the other side, i.e. to the side of the web material N facing outwards, with a rewinder configuration of the type shown in FIG. 2. The perforation line P comes to be in the vicinity of the tail end of the sheet F. Pushing axially on the nucleus R1 makes it slide out of the outer portion R2, leaving the latter with an unlined hole in the middle, while the extracted inner portion R1 is lined with the sheet F adhering to said nucleus.

In the above-described examples, the assumption is that an adhesive is applied in the vicinity of the leading end of the sheet of separator material, i.e. to the end further forward with respect to the direction in which the web material is being fed forward. As mentioned previously, however, this is not the only way to anchor a sheet of separator material to the web material. For instance, said anchorage may be obtained by means of a mechanical crimping or ultrasound, electrostatic charging, embossing, or by any other means. When such alternative options are used, it is advantageous to provide for the mutual adhesion between the sheet material and the web material to extend approximately over the full length of the sheet material.

When an adhesive is used, on the other hand, said adhesive may also be applied in several spots and not only in the vicinity of the leading end of the sheet material.

Figures from 12 onwards schematically show methods for applying the adhesive in several spots. In each figure, N indicates a portion of the web material advancing in the direction of the arrow fN; the letter P indicates a perforation line along which the web material N wound on the roll is torn when the two portions R1 and R2 are subjected to a force to extract the former from the latter. The letter F indicates the sheet of separator material when only a single sheet is used, while F1 and F2 are used to indicate the two sheets of separator material when two sheets of said material are used in the same roll R.

Figure 12:
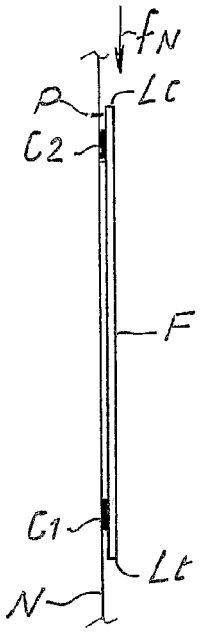
FIGS. 12 to 15 schematically show different methods for applying a separator material in sheet form to the web material.

FIG. 12 shows the position for applying a sheet F on the web material N so that it remains wrapped around the nucleus R1 of the roll R. In this case, the sheet is attached with two areas of adhesive C1 and C2, applied in the vicinity of the leading end Lt and tail end Lc of the sheet F. With a double crosswise line of adhesive C1, C2, the sheet F remains attached to the inner nucleus R1, thus keeping it wound even when it has been completely removed from the outer portion R2. The perforation line is in the vicinity of the tail end Lc, downstream from the line of adhesive C2. Said adhesive may seep through to anchor the last turn of the portion R1 to the inner turn. It can also be applied to the side of the web material N opposite the side to which the sheet F is attached and spread so as to make the latter adhere to the web material N.

Figure 13:
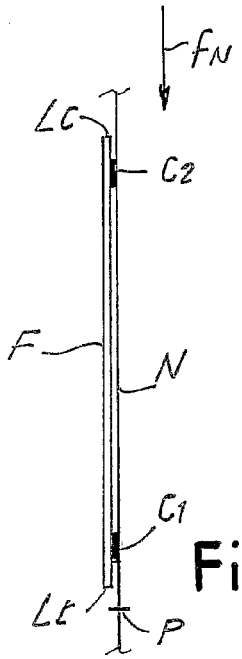

In FIG. 13 the sheet F is applied to the opposite side of the web material N, downstream from the perforation line P, here again with two areas of adhesive C1 and C2, in the vicinity of the leading end Lt and tail end Lc, respectively. The adhesive C2 can serve to avoid any loss of control over the tail end Lc.

Figure 14:
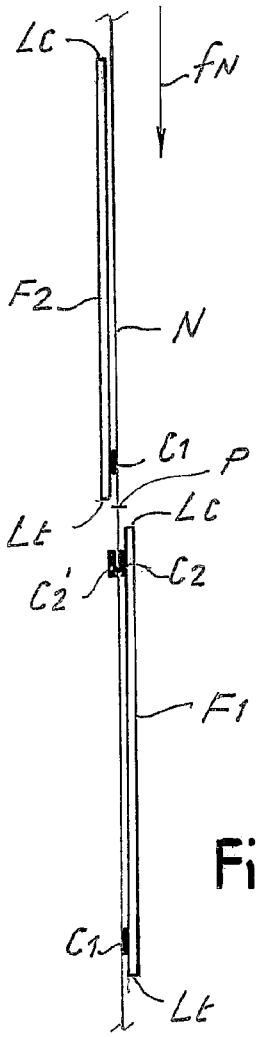
Figure 15:
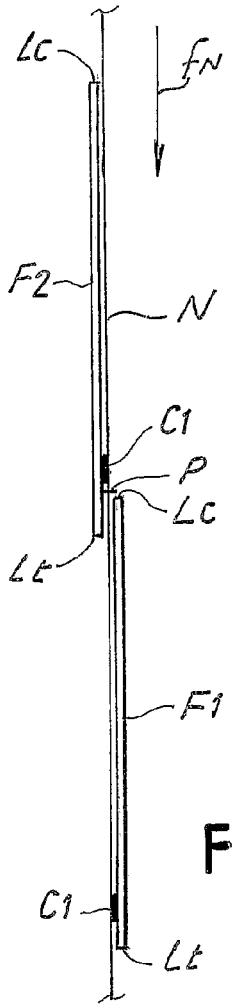

FIGS. 14 and 15 show two methods for applying two sheets of separator material F1, F2 to the web material N. In the first case, the perforation line P comes to be between the tail end Lc of the first sheet F1 and the leading end Lt of the second sheet; the two sheets F1, F2 do not overlap. The sheet F1 is anchored by means of two spots of adhesive C1 and C2. A second spot or line of adhesive C2' can be applied on the side opposite the side on which the sheet F1 is applied. A similar solution can also be adopted in the case of FIG. 12, here again so as to attach the loose end of the portion R1 of the roll.

In FIG. 15 the tail end Lc of the sheet F1 overlaps the leading end Lt of the sheet F2, with the perforation line P coming between the two.

Generally speaking, when a single sheet of separator material F is used, it can be attached either to the portion R1 or to the portion R2 of the roll R, depending on its position with respect to the perforation line P and the position of the adhesive C1.

In the various examples illustrated above, it is assumed that a single sheet of separator material is applied to one side of the web material N, or two sheets are applied, one on each side. Alternatively, in addition to using a separator material other than in the form of sheets, e.g. a waxy material applied in the form of a spray, one or more sheets of separator material can also be applied at intervals, the global coverage of which might equate to one turn of web material, or less. In fact, covering an area corresponding to half or two thirds of the length of one turn, for instance, with separate material is sufficient to obtain a mutual sliding between the portions R1 and R2 of the web material.

According to a preferred embodiment of the invention, the separator material—be it in the form of a sheet material or of a loose material distributed over the surface of the web material—is suitable for dissolving or dispersing in water so that it can be disposed of directly in the WC.

Figure 16:
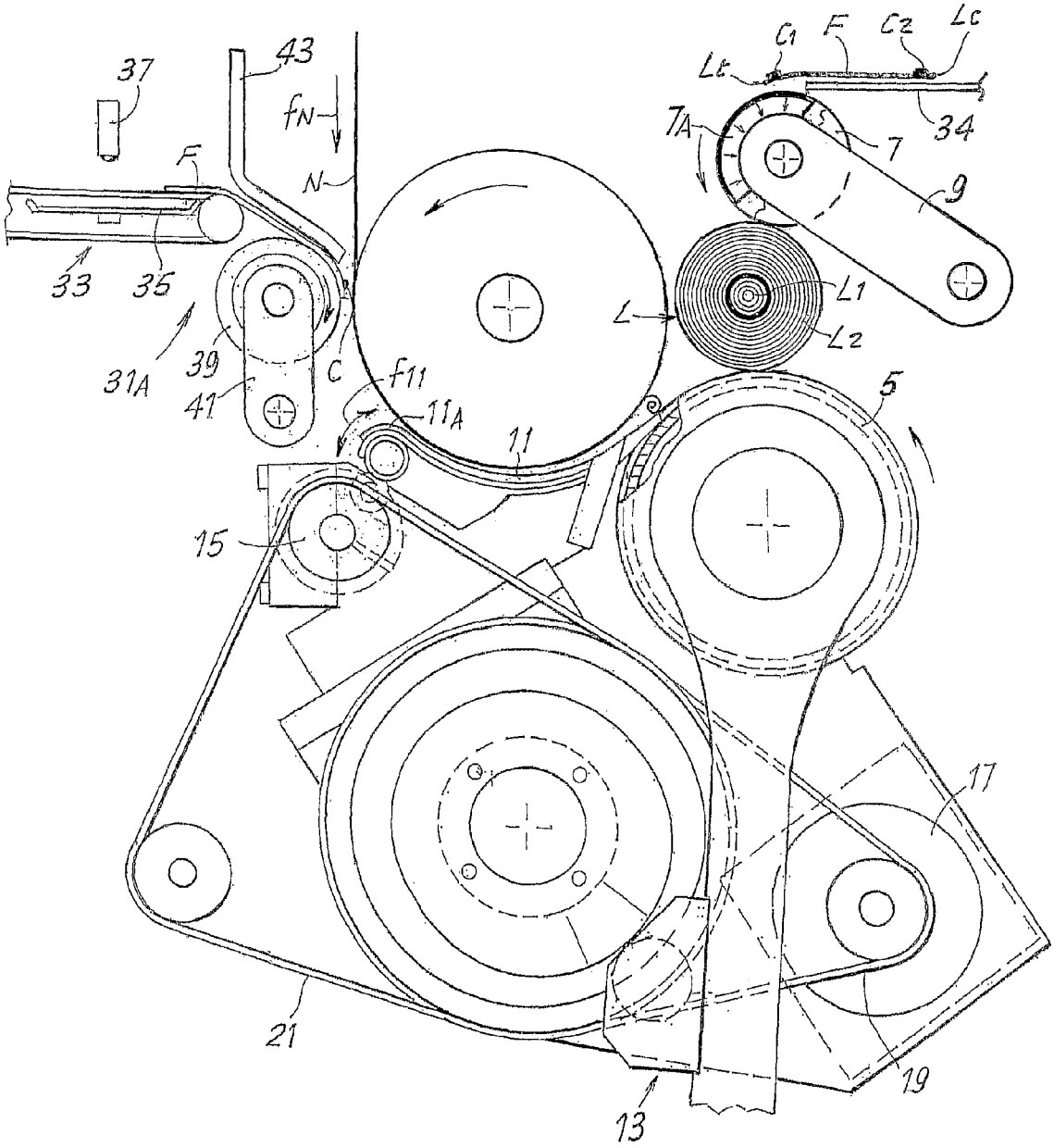
FIGS. 16 and 17 show a different embodiment of the machine according to the invention.
Figure 17:
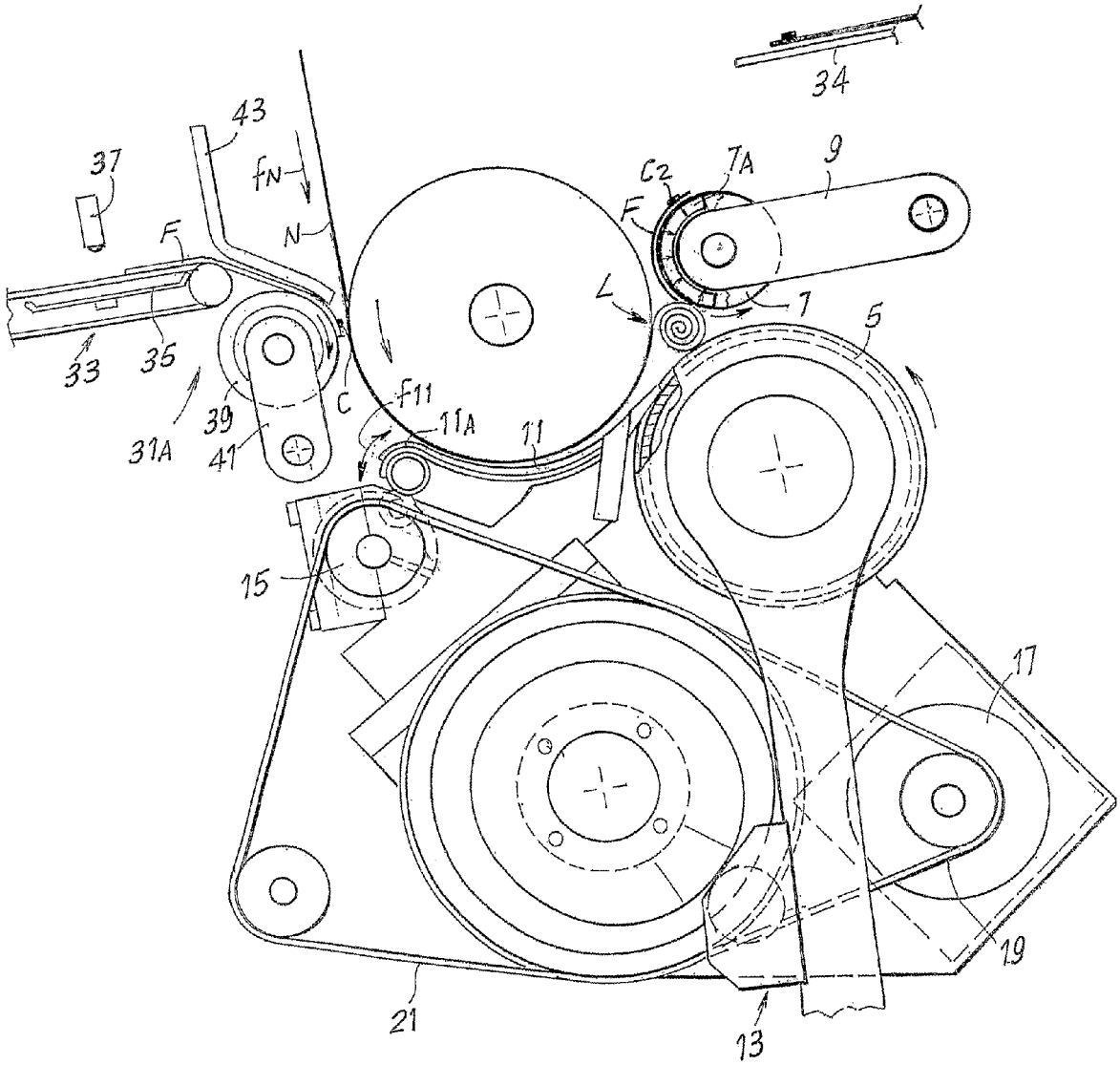

Instead of using additional distributors or applicators of the separator material, in a possible alternative embodiment, the separator material for wrapping around the central nucleus R1 could be applied using the mobile-axis winder roller 7. A solution of this type is illustrated in FIGS. 16 and 17. The same numbers indicate parts corresponding or equivalent to those of the embodiment in FIG. 3. The upper winder roller 7 is associated with a sheet feeder 31B that, in the schematic illustration in the drawing, comprises a surface 34 for delivering the sheets F, which can be fed forward by means of feed rollers (not shown), or belts, or by any other means, and can consist of pre-cut sheets or lengths of a material in sheet form delivered from a reel. Two lines of adhesive C1 and C2, which may or may not be discontinuous, are applied to the sheet F, one in the vicinity of the leading end Lt and one in the vicinity of the tail end Lc. The feed plane is set at a level (which may be adjustable) so that the mobile roller 7 comes to be into the vicinity of said plane when the completed log L is unloaded from the winding cradle (FIG. 16). In this position, possibly after an upward overtravel of the oscillating arms 9 supporting the roller 7, the leading end Lt of the sheet F is engaged by suction on the roller 7, which has a suction segment 7A. At this point, the central nucleus L1 of the next log L begins to form and reaches or has passed through the nip between the winder rollers 3 and 5, but it has not yet reached the diameter required for the portion L1.

FIG. 17 shows the next stage, wherein the log L has been unloaded and the roller 7 has been lowered, bringing the sheet F with its leading end Lt into contact with the initial portion of the currently forming roll. The peripheral speed, angular position and lowering movement of the roller 7 are phased so as to induce the anchorage of the leading end Lc by means of the adhesive C1 on the outermost turn of the portion L1 of the nucleus that has been formed. The tail end Lc can be glued by means of the adhesive C2 (if any), or remain loose, since it is engaged and held in place in any case by the next turn of the web material N.

There may be a feeder 31A, in which case it works as explained with reference to FIG. 3 and serves the same purpose. Said feeder may also be omitted, however.

In the previously-described embodiments, an interface is created between the nucleus or inner portion R1 of the roll and the outer portion R2 of the roll by applying a separator material, typically in the form of a sheet adhering to the web material. The separator interface between the two concentric portions of each roll can also be generated by other means, however. For instance, a localized change can be made to the roughness or any other characteristic of the surface of the web material (preferably affecting the friction coefficient) over a stretch of material corresponding to approximately half a turn, or a full turn, or even a number of turns, e.g. 2 or 3 turns, or an even larger number of turns, for instance coming between 1 and 50, and preferably between 1 and 20, between the inner portion and the outer portion of the roll.

Figure 18:
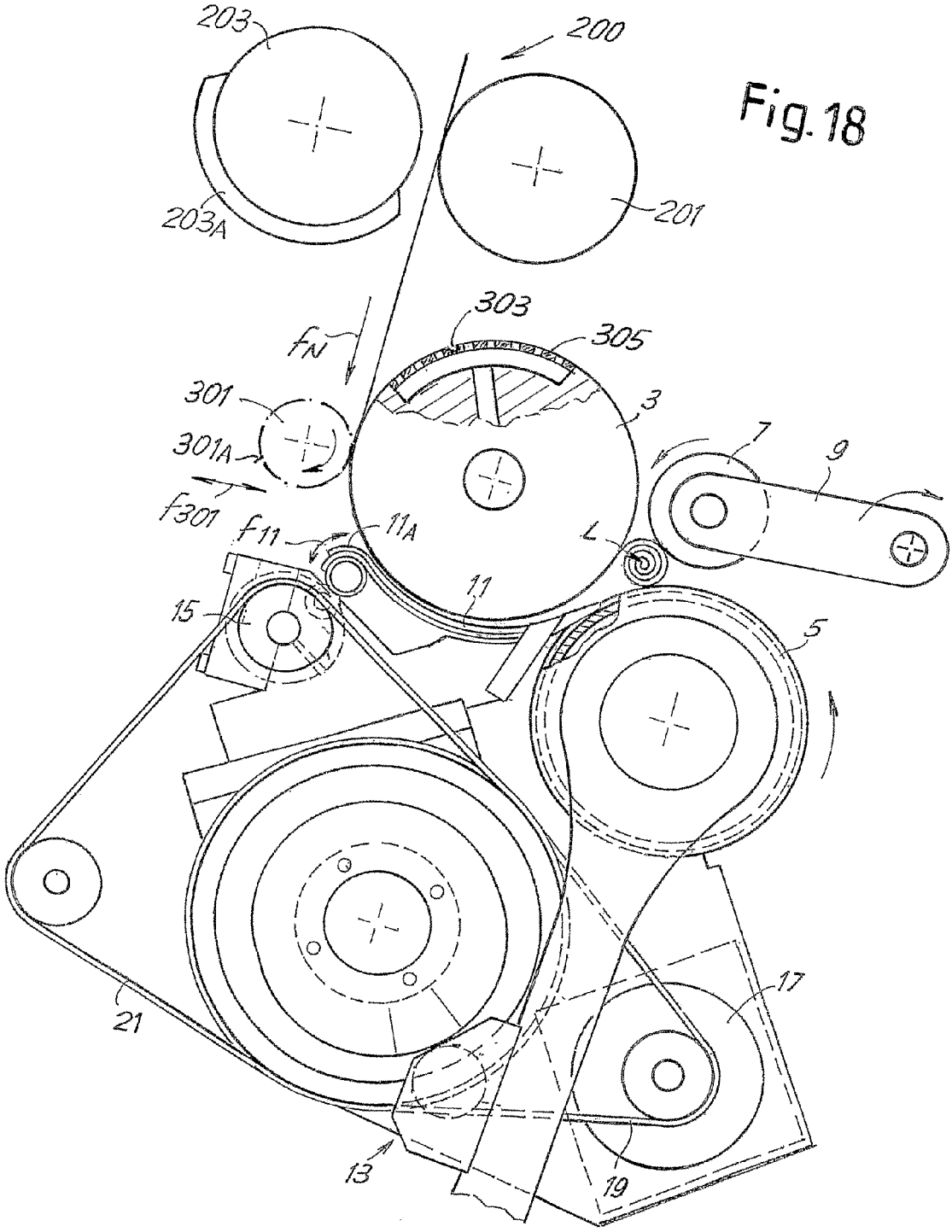
FIG. 18 schematically shows a side view of a machine in a further embodiment of the invention.

The web material (typically tissue paper) can, for instance, be calendered to make it smoother. FIG. 18 schematically illustrates a rewinder machine substantially similar to the one in FIG. 4, wherein the system for feeding the sheets F is omitted and replaced by a calendar 200 comprising two rollers 201 and 203. In the example illustrated, the roller 201 has a cylindrical lateral surface of constant radius, while the roller 203 has a portion 203A that is larger in diameter. Thus, the roller 201 can be kept turning constantly, while the roller 203 only turns when the interface needs to be generated between the two (inner and outer) portions of the roll or log. By rotating the roller 203, even through just one turn, the portion 203A is pressed against the roller 201. The radius of said portion 203A is such that said portion squeezes and thereby calenders the web material N. This calendering action is performed over a portion of material, the length of which equates to the length of the portion 203A.

Alternatively, the two rollers 201, 203 can have constant diameters and be pressed one against the other at a suitable time. The roller 201 can be kept turning continuously or, like the roller 203, it can be turned only when the calendering of the web material is required.

The interface between the inner and outer portions of the roll or log can also be generated by means of a localized variation in the density of the winding. This can be achieved by modifying the pressure exerted by the roller 7 on the roll or log L, or by adjusting the turning rate of the rollers, or by combining these effects.

FIG. 18 shows a further possible characteristic of the machine according to the invention. This consists in the presence of a cutting roller 301 complete with a cutter blade 301A or other cutting means, cooperating with a counter-blade or groove 303 in the surface of the winder roller 1. The cutting roller 301 can be brought up to and drawn away from the roller 1 so that the blade 301A only cooperates with the counter-blade 303 when a crosswise cut is required. Alternatively, the cutting roller can be made to complete only one turn when a cut is required. In this way, a crosswise cut can be made in the web material in line with the area of said material coinciding with the interface or discontinuity between the inner and outer portions of the roll. This will facilitate the mutual sliding between the two said portions. A portion of cylindrical surface of the winder roller 1 on the two sides of the counter-blade 303 is perforated and in communication with a suction box, enabling the resulting suction effect to retain the ends of web material generated by the cutting action so that they can be transferred to the area where the roll or log is being formed.

Alternatively, especially if no perforation of the web material is required, the blade 301A can be serrated to generate a single perforation line in each roll, coinciding with the area of the interface or discontinuity that separates the two, inner and outer portions of the roll. Both a single transversal perforation in the area of the interface between the inner and outer portions, and perforation lines dividing the web material into single detachable sheets can be made in this way. This method can be used to create a more marked perforation line in the area of the interface or discontinuity, thereby facilitating the extraction of the inner from the outer portion of the roll.

It should be understood that the drawing only illustrates one example, given simply as a practical demonstration of the invention, which may vary in the forms and arrangements, without departing from the concept of the invention. Any reference numbers in the attached claims are merely for the purpose of facilitating the reading of the claims with reference to the description and the drawing, and shall not restrict the coverage of the patent as represented in the claims.

The invention claimed is:

1. A roll of coreless web material comprising a first inner portion of web material forming an inner nucleus of said roll, and a second outer portion of web material wound around outside said inner nucleus, wherein between said first inner portion forming said inner nucleus and said second outer portion wound around the outside of said inner nucleus is an interface that facilitates mutual sliding between said first inner portion and said second outer portion, wherein said first inner portion and said second outer portion of web material form two independently usable products in a form of rolls of web material.

2. The roll as claimed in claim 1, wherein said interface comprises a separator material applied to at least one turn of web material coming between said inner nucleus and said second outer portion of the web material, said separator material facilitating extraction of said inner nucleus from said second outer portion of the roll.

3. The roll as claimed in claim 2, wherein said separator material is applied over a length of web material corresponding to approximately half a turn to approximately one turn of the web material.

4. The roll as claimed in claim 2, wherein said separator material is applied in line with a transverse perforation line on the web material.

5. The roll as claimed in claim 2, wherein said separator material is applied to at least one side of the web material.

6. The roll as claimed in claim 2, wherein said separator material is a sheet material.

7. The roll as claimed in claim 6, wherein said separator material is made of paper.

8. The roll as claimed in claim 6, wherein said separator material is made of plastic.

9. The roll as claimed in claim 6, wherein said separator material is applied to both sides of the web material forming the roll.

10. The roll as claimed in claim 9, wherein said separator material comprises two staggered sheets of web material inserted in said roll.

11. The roll as claimed in claim 2, wherein said separator material adheres to the web material forming the roll.

12. The roll as claimed in claim 11, wherein said separator material is adhered to the web material forming the roll by an adhesive, crimping, embossing, or electrostatic charges.

13. The roll as claimed in claim 2, wherein said separator material is a sheet material with a leading end and a tail end, that is attached to the web material in a vicinity of the leading end, while the tail end is positioned in a vicinity of a perforation line in the web material.

14. The roll as claimed in claim 13, wherein said sheet material is anchored to the web material in a vicinity of both the leading end and the tail end.

15. The roll as claimed in claim 2, wherein said separator material is a sheet material with a leading end and a tail end, that is attached to the web material in a vicinity of the leading end, and said leading end is positioned in a vicinity of a perforation line in the web material.

16. The roll as claimed in claim 1, wherein said interface comprises a variation in winding density of said web material.

17. The roll as claimed in claim 16, wherein said interface is formed by a portion of the web material wound more loosely than the winding density of the first inner portion and of the second outer portion of said roll.

18. The roll as claimed in claim 17, wherein said interface is formed by a portion of the web material wound more loosely, over a length of the web material ranging between half a turn and fifty turns.

19. The roll as claimed in claim 1, wherein said interface comprises of one or more turns formed by a length of web material and having a different surface structure from the web material forming said first inner portion and said second outer portion.

20. The roll as claimed in claim 19, wherein said length of web material has a lower surface roughness than the web material forming said first inner portion and said second outer portion.

21. The roll as claimed in claim 19, wherein said length of web material is calendered.

22. The roll as claimed in claim 1, wherein said web material is made of paper.

23. The roll as claimed in claim 1, wherein said inner nucleus has a diameter of between 0.5 and 5 cm.

24. A roll of coreless web material comprising a first portion of web material forming an inner nucleus of said roll, and a second portion of web material wound around outside said inner nucleus, wherein between said first portion forming said inner nucleus and said second portion wound around the outside of said inner nucleus is an interface that facilitates mutual sliding between said first portion and said second portion, wherein said interface comprises a separator material applied to at least one turn of web material coming between said inner nucleus and said second portion of the web material, wherein said separator material facilitates extraction of said inner nucleus from said second portion of the roll, is applied to both sides of the web material forming the roll, and is a sheet material comprising two staggered sheets of web material inserted in said roll, wherein said two staggered sheets are arranged so that when a center of said inner nucleus of the roll is pressed to make said inner nucleus slide axially with respect to the second portion, inducing tearing of the web material along a perforation line present therein, a first sheet of said two staggered sheets remains wound around the inner nucleus, and a second sheet of said two staggered sheets remains inside a hole created in a remainder of the roll following extraction of said inner nucleus.

25. The roll as claimed in claim 24, wherein said perforation line is positioned in an intermediate area between two ends of the two staggered sheets of separator material.

26. Method for manufacturing a coreless roll of web material, comprising providing a first central portion of web material forming a nucleus, winding a second outer portion of web material around said first central portion, providing an interface between said first central portion and said second outer portion, wherein said interface is constructed and arranged to facilitate extraction of said first central portion from said second outer portion, wherein said first central portion and said second outer portion of web material form two independently usable products in a form of rolls of web material.

27. The method as claimed in claim 26, comprising steps as follows:

winding a first length of web material to form said first central portion;

creating said interface;

winding a second length of web material to form said second outer portion.

28. The method as claimed in claim 26, comprising steps as follows:

curling a free end of a first length of said web material and winding the first length of the web material to form the first central portion creating the nucleus of said roll;

creating the interface in said winding;

continuing to wind on a second length of web material to form the second outer portion of web material wound around said first central portion of web material to complete said roll, said interface being arranged between said first central portion and said second outer portion.

29. The method as claimed in claim 26, further comprising said interface is provided by applying a separator material to at least one side of said web material in a length of the web material between said first central portion and said second outer portion.

30. The method as claimed in claim 29, wherein said separator material is applied to both sides of said web material.

31. The method as claimed in claim 29, wherein said web material includes transverse perforation lines spaced equidistant from each other, and wherein said separator material is applied in line with at least one of said perforation lines.

32. The method as claimed in claim 31, wherein said separator material is applied downstream from one perforation line of said transverse, perforation lines.

33. The method as claimed in claim 32, wherein said separator material includes a leading end and a tail end, and said separator material is applied with the leading end positioned upstream from said one perforation line and with the tail end positioned approximately in line with said one perforation line.

34. The method as claimed in claim 29, wherein said separator material is a bulk material applied to a surface of the web material.

35. The method as claimed in claim 34, wherein said bulk material is applied by spraying or spreading.

36. The method as claimed in claim 34, wherein said bulk material contains wax.

37. The method as claimed in claim 29, wherein said separator material is a sheet material.

38. The method as claimed in claim 37, wherein said sheet material is made of plastic.

39. The method as claimed in claim 37, wherein said sheet material is made of paper.

40. The method as claimed in claim 37, wherein said sheet material is attached to a surface of the web material forming the roll.

41. The method as claimed in claim 40, wherein said sheet material is glued to the surface of the web material.

42. The method as claimed in claim 29, wherein a first length of web material that is wound before the separator material is applied, forms the nucleus with a diameter of between 0.5 and 5 cm.

43. The method as claimed in claim 26, wherein said interface is provided by varying the web material winding density.

44. The method as claimed in claim 43, wherein said interface is provided by a localized reduction in the winding density, said first central portion of web material and said second outer portion of web material being wound with a greater winding density than the winding density of one or more turns of web material coming between said first central portion and said second outer portion.

45. The method as claimed in claim 26, wherein said interface comprises one or more turns of a stretch of web material having a surface structure different from a surface structure of the web material forming said first central portion and said second outer portion.

46. The method as claimed in claim 45, wherein said stretch of web material has a lower surface roughness than the surface structure of said first central portion and said second outer portion.

47. The method as claimed in claim 45, wherein said stretch of web material is calendered.

48. The method as claimed in claim 26, wherein said web material forming the roll is paper.

49. The method as claimed in claim 26, wherein said interface is provided by combining of at least two of a separator material, a localized variation in winding density, and a change in at least one surface feature of the web material.

* * * * *